US006676392B1

(12) United States Patent
Hwang et al.

(10) Patent No.: US 6,676,392 B1
(45) Date of Patent: Jan. 13, 2004

(54) SMALL-SIZED COMPRESSOR

(75) Inventors: Dong-Il Hwang, Paju (KR); Bin Hwang, Seoul (KR)

(73) Assignee: Dovicom Technol Co., Ltd., Seoul (KR)

( * ) Notice: Subject to any disclaimer, the term of this patent is extended or adjusted under 35 U.S.C. 154(b) by 0 days.

(21) Appl. No.: 09/959,019

(22) PCT Filed: Apr. 24, 2000

(86) PCT No.: PCT/KR00/00384

§ 371 (c)(1),
(2), (4) Date: Feb. 21, 2002

(87) PCT Pub. No.: WO00/65236

PCT Pub. Date: Nov. 2, 2000

(30) Foreign Application Priority Data

Apr. 23, 1999 (KR) ..... 1999-14710
Apr. 23, 1999 (KR) ..... 1999-14711
Oct. 12, 1999 (KR) ..... 1999-44189

(51) Int. Cl.[7] ..... F04C 18/04
(52) U.S. Cl. ..... 418/59
(58) Field of Search ..... 418/59

(56) References Cited

U.S. PATENT DOCUMENTS 453,641 A * 6/1891 Johnson ..... 418/59
3,125,032 A * 3/1964 Smith ..... 418/59
3,560,119 A * 2/1971 Busch et al. ..... 418/59
3,782,865 A * 1/1974 Braun ..... 418/59

FOREIGN PATENT DOCUMENTS

FR 836142 * 10/1938 ..... 418/59

* cited by examiner

*Primary Examiner*—John J. Vrablik

(57) ABSTRACT

A small-sized, efficient compressor has a compressed air tank, a first housing provided with a shaft bore, a rotating shaft, an orbiter, a second housing, a rotation restrainer and a circular vane. The orbiter is provided at a lower portion thereof with a cam shaft hole to engage with the cam shaft portion of the rotating shaft without friction, and is adapted to form a ring-shaped operating portion above the orbiter to form a circular space. The second housing is attached to the first housing and forms a second circular space offset from the circular space. The circular vane is formed in the second housing to form a ring-shaped compression chamber within the operating portion of the orbiter. Air is compressed and discharged through a discharge hole of the circular vane to generate a large amount of highly compressed air.

1 Claim, 6 Drawing Sheets

SMALL-SIZED COMPRESSOR

TECHNICAL FIELD

The present invention relates, in general, to a small-sized compressor and, more particularly, to a small-sized compressor, in which a circular space surrounded by a ring gear at its circumference and a ring-shaped operating portion are formed at one side of an orbiter that receives the rotating force of a rotating shaft inserted into a first housing, another circular space surrounded by another ring gear and a circular vane are formed in a second housing attached to a first housing, so that air supplied through an air supply hole of the second housing is compressed and is discharged through a discharge hole of the circular vane, thereby generating a large amount of highly compressed air in a relatively small space and being operated effectively.

BACKGROUND ART

In general, a compressor is an apparatus in which one or more vanes elastically sustained by springs to be reciprocated are mounted to a rotor eccentrically and rotably mounted in a cylinder, thereby compressing fluid, such as oil or air, and discharging the compressed fluid through an air outlet while the vanes pushed to the outside are in contact with an inner surface of the cylinder as the rotor is rotated.

In the conventional small-sized compressor, a space between its cylinder and its rotor, which is rotated in the cylinder around an eccentric rotating shaft, is varied while the rotor gets close to and gets away from the cylinder. As the space is varied, its vanes become projected to the outside by the elastic force of a spring or become pushed to the inside by the inner wall of the cylinder. Accordingly, when the rotor is rotated fast, the vanes may be easily damaged in the process of being moved to the outside or inside. As a result, the conventional compressor is problematic in that the rotor cannot be rotated fast and the material and size of the vanes are limited because the vanes are easily damaged.

In order to overcome the above-described disadvantages of the conventional compressor, Korean Pat. Appln. No. 95-42007 was proposed, as shown in FIG. 1.

In the vane pump of the above-described patent application, an inner rotor 3 having upper and lower radial air circulation holes 4 and 5 and air inlets 6 and 7 are integrally mounted around a shaft 1 having a spiral shaft hole 2 at its central portion and being rotated by a motor (not shown).

Air is supplied to the air circulation holes 4 and 5 through a large shaft hole 12 of an outer rotor 11 that is positioned to be offset from the shaft 1 while projected vanes are disposed in a ring-shaped operating portion.

An enclosed space defined by the outer surface of the inner rotor 3 and the inner surface of the outer rotor 11 is divided into a compression chamber and a supply chamber by the vane, and the air compressed in the compression chamber is discharged into the outside through the discharge hole of the outer rotor 11 by the variation of the volume of the compression chamber and the supply chamber.

In a housing 21 in which an enclosed type compressed air storage chamber is formed beside the outer rotor 11, air is supplied through air supply passages 22 and 23 connected to the outside to the large shaft hole 12 of the outer rotor 11 and, at the same time, the compressed air in the compressed air storage chamber is supplied to an outer compressed air tank.

An oil circulation groove 28 is formed in a portion that is in contact with the outer rotor 11 of the housing 21 at which oiling portions 26 and 27 are formed near oil supply holes 8 and 9, and an oil circulation hole 15 is formed within the large shaft hole 12 of the outer rotor 11 in contact with the shaft 1.

The oil circulation holes 28 and 15 are connected to the air circulation passage 16, thereby generating highly compressed air in an enclosed small space and being maintained to be mounted onto an air conditioner.

However, in the conventional vane pump as described above, since compressed air is temporarily stored in the compressed air chamber beside the housing 21 and is discharged to the outside while the shafts of the inner rotor 3 and the outer rotor 11 are different and the vane is inserted into the operating portion, the inner rotor 3, wherein the vane of the outer rotor 11 is inserted into the operation hole, comes into collision with the vane while being eccentrically rotated, and the vane comes into contact with both sides of the operation hole, thereby generating collision noise and abrasion during the compression of air.

Additionally, the leakage of compressed air occurs because the operating portions of the outer rotor 11 and the inner rotor 3 do not come into contact with each other, the construction for rotating the outer rotor 11 and the inner rotor 3 is complicated and the size of the compressor is large due to the complication of the construction.

DISCLOSURE OF THE INVENTION

Accordingly, the present invention has been made keeping in mind the above problems occurring in the prior art, and an object of the present invention is to provide a small-sized compressor, in which a circular space surrounded by a ring gear at its circumference and a ring-shaped operating portion are formed at one side of an orbiter that receives the rotating force of a rotating shaft inserted into a first housing, another circular space surrounded by another ring gear and a circular vane are formed in a second housing attached to a first housing, so that air supplied through an air supply hole of the second housing is compressed and is discharged through a discharge hole of the circular vane, thereby generating a large amount of highly compressed air in a relatively small space and being operated effectively.

In order to accomplish the above object, the present invention provides a small-sized compressor, including a compressed air tank; a first housing provided with a shaft bore; a rotating shaft disposed inside the compressed air tank to be rotated by a motor, inserted into the shaft bore of the first housing, and provided at an upper end thereof with a cam shaft portion; an orbiter provided at a lower portion thereof with a cam shaft hole to engage with the cam shaft portion of the rotating shaft without friction, and adapted to form a ring-shaped operating portion above the orbiter to form a circular space surrounded by a ring gear, a second housing attached to the first housing in a general bolting manner, and adapted to form a circular space offset from the circular space and surrounded by a ring gear; a rotation restrainer provided with two sun gears, and disposed in the circular spaces so that the sun gears engage with the ring gears, respectively; and a circular vane integrated with the second housing through a connecting portion to form a ring-shaped operating portion of the orbiter; wherein the second housing is provided therethrough with and air supply hole, and the circular vane is provided therethrough with an air outlet to connect an interior of the compressed air tank and an open portion of the second housing.

BRIEF DESCRIPTION OF THE DRAWINGS

The above and other objects, features and other advantages of the present invention will be more clearly understood from the following, detailed description taken in conjunction with the accompany drawings, in which.

BEST MODE FOR CARRYING OUT THE INVENTION

Figure 1:
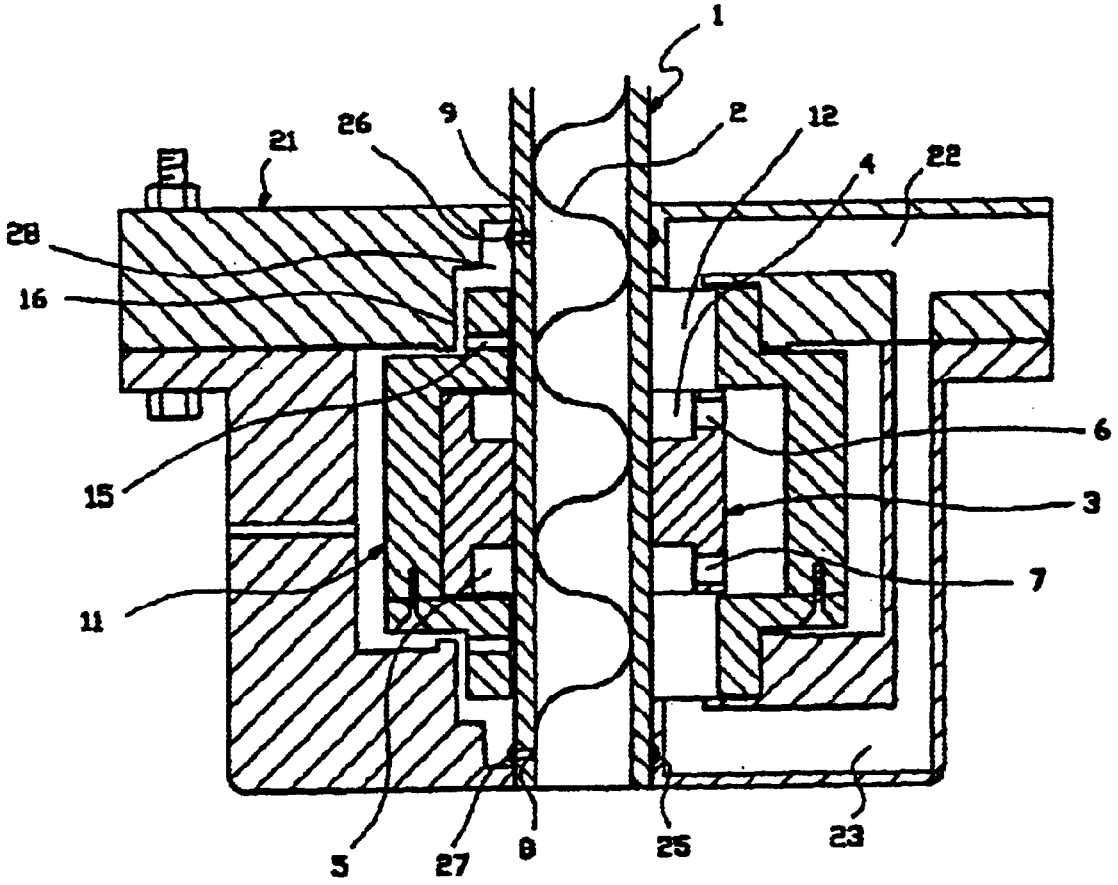
Fig.1 (PRIOR ART)
FIG. 1 is a vertical sectional view showing the construction of a conventional vane pump.
Figure 2:
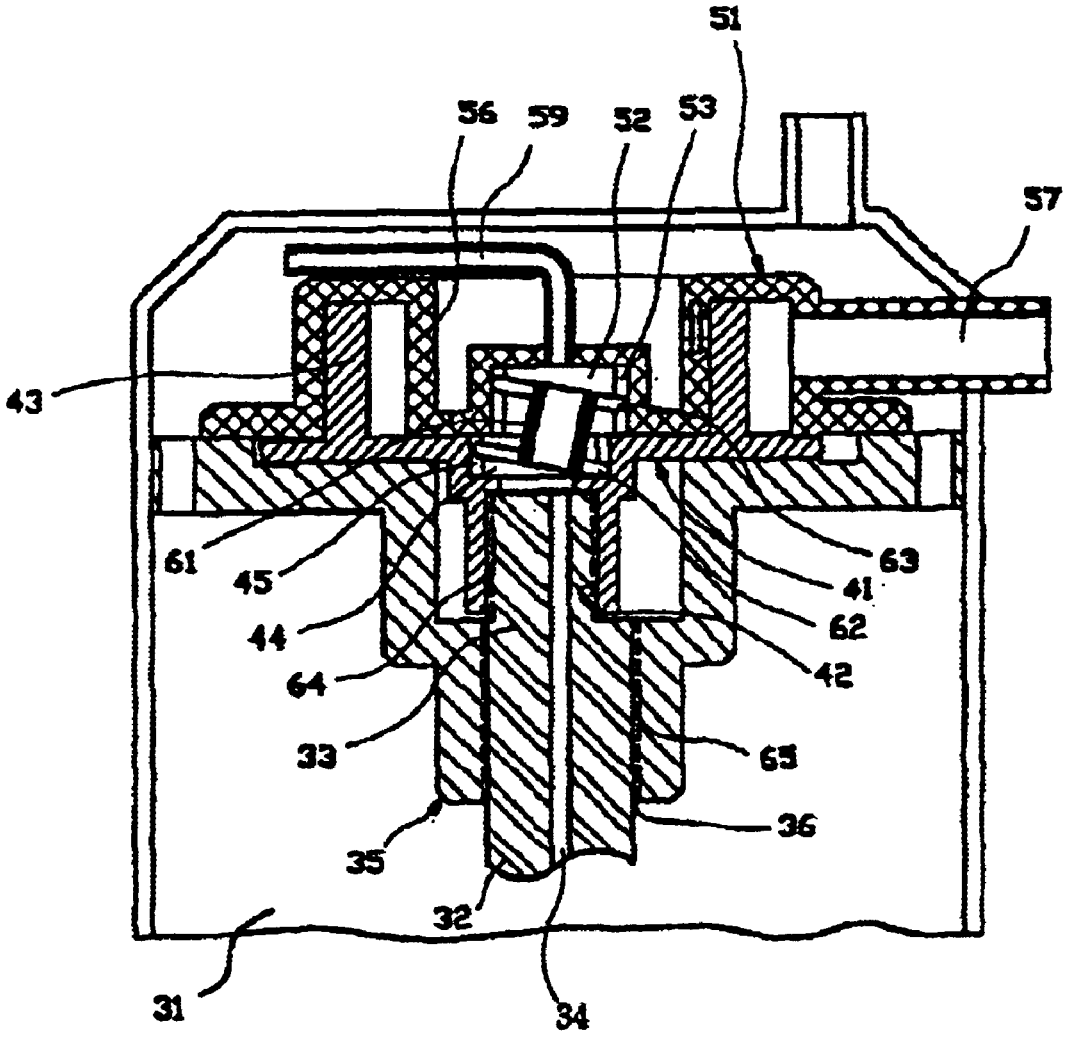
FIG. 2 is a vertical sectional view showing a vane pump in accordance with a first embodiment of the present invention.

A preferred embodiment of the present invention is described with reference to the accompanying drawings, hereinafter.

FIGS. 2 and 3A to 3D are views showing a small-sized compressor in accordance with a first embodiment of the present invention.

The small-sized compressor of the present invention includes a compressed air tank 31, and a first housing 35 provided with a shaft bore 36.

A rotating shaft 32 is disposed inside the compressed air tank 31 to be rotated by a motor (not shown) inserted into the shaft bore 36 of the first housing 35, and provided at an upper end thereof with a cam shaft portion 33.

An orbiter 41 is provided at a lower portion thereof with a cam shaft portion 33 of the rotating shaft 32 without friction, and adapted to form a ring-shaped operating portion 43 above the orbiter 41 to form a circular space 44 surrounded by a ring gear 45.

A second housing 51 is attached to the first housing 35 in a general bolting manner, and adapted to form a circular space 52 offset from the circular space 44 surrounded by a ring gear 53.

A rotation restrainer 61 is provided with two sun gears 62 and 63, and disposed in the circular spaces 44 and 52 so that the sun gears 62 and 63 engage with the ring gears 45 and 53 respectively.

A circular vane 56 is integrated with the second housing 51 through a connecting portion 55 to form a ring-shaped compression chamber 54 together with the second housing 51, and disposed within the ring-shaped operating portion 43 of the orbiter 41.

The second housing 51 is provided therethrough with an air supply hole 57, and the circular vane 56 is provided therethrough with an air outlet 58 to connect an interior of the compressed air tank 31 and an open portion of the second housing 51.

An oil circulation groove 64 is formed around the cam shaft portion 33 of the rotating shaft 32 fitted into the cam shaft hole 42 of th orbiter 41 and an oil circulation groove 65 is formed around the rotating shaft 32 fitted into the shaft bore 36 of the first housing 35, so that the oil is circulated through the oil circulation grooves 64 and 65 to allow the rotating shaft 32 to be smoothly rotated in the first housing 36 and to move the orbiter 41.

The small-sized compressor constructed as described above generates compressed air and supplies the compressed air to an outside air conditioner while its rotating shaft 32 is rotated in the compressed air tank 31 by the motor.

Oil that is moved upward through the shaft central hole 34 formed in the central portion of the rotating shaft 32 is supplied to the circular spaces 44 and 52 to which the rotation restrainer 61 is mounted and lubricates the portions at which the orbiter 41 and the second housing 51 are in contact with each other.

While the oil is circulated through the oil circulation groove 64, which is formed around the cam shaft portion 33 of the rotating shaft 32 engaging with the cam shaft hole 42, and the oil circulation groove 65, which is formed around the rotating shaft 32 inserted into the shaft bore 36 of the first housing 35, the oil allows the rotating shaft 32 to be smoothly rotated and to move the orbiter 41 while being inserted into the first housing 36.

The rotating shaft 32, which is rotated in the compressed air tank 31 by the motor while being inserted into the shaft bore 36 of the first housing 35, is rotated and moves the orbiter 41 that engage with the cam shaft portion 33 of the rotating shaft 32 in its cam shaft hole 42.

The orbiter 41 performs a stable orbiting movement in such a way that the ring-shaped operating portion 43 of the orbiter 41 is not only disposed between the ring-shaped compression chamber 54 and the circular vane 56, but also the sun gears 62 and 63 of the rotation restrainer 61 engage with the ring gears 45 and 53 of the circular spaces 44 and 52, respectively.

Figure 3A:
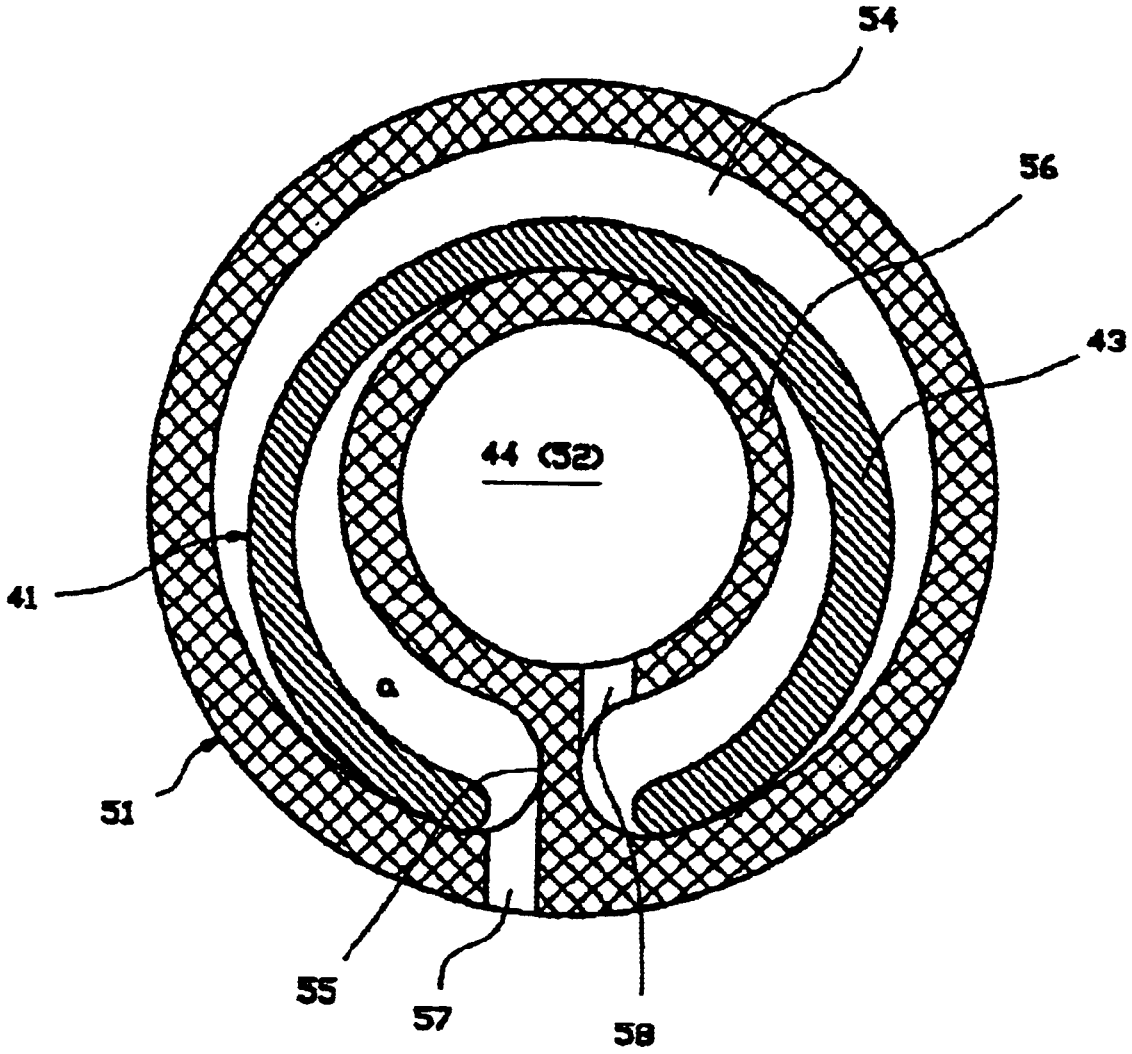
FIGS. 3A to 3D are horizontal sectional views showing the operation of the vane pump in accordance with the first embodiment.

As illustrated in FIG. 3A, in the state where air has entered the non-compressed space "a" of the compression chamber 54, as the rotating shaft 32 is rotated, the orbiter 41 performs a clockwise orbiting movement with the aid of the rotation restrainer 61 retained by the second housing 51.

Figure 3B:
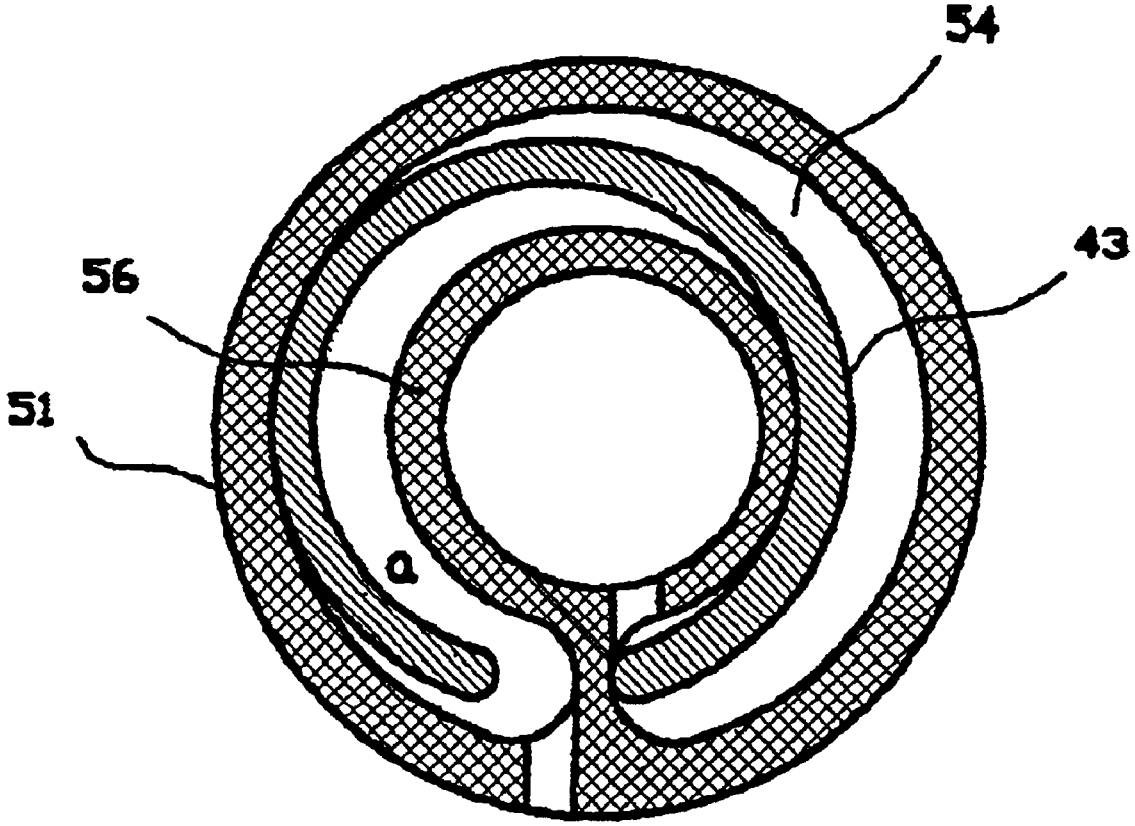

As illustrated in FIG. 3B, when the orbiter 41 performs an orbiting movement of 90° with the aid of the rotating shaft while the circular vane 56 of the second housing 51 is fitted into the ring-shaped operating portion 43 of the orbiter 41, the non-compressed space "a" is defined by the ring-shaped operating portion 43 of the orbiter 41 and the circular vane 56 of the second housing 51.

Figure 3C:
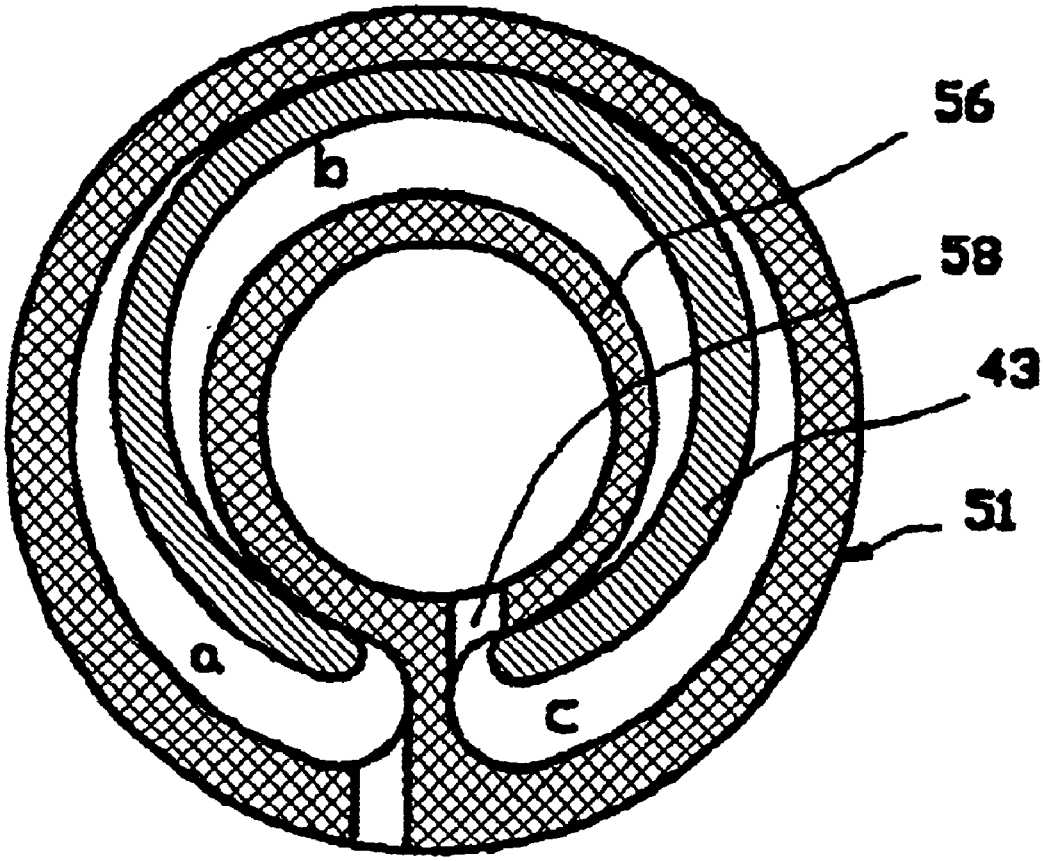

As illustrated in FIG. 3C, when the orbiter 41 performs an orbiting movement of 180°, the compression chamber 54 is divided into the non-compressed "a", the compressed space "b" and the completely compressed space "c" and the compressed "b" of the compression chamber 54 is compressed more.

Figure 3D:
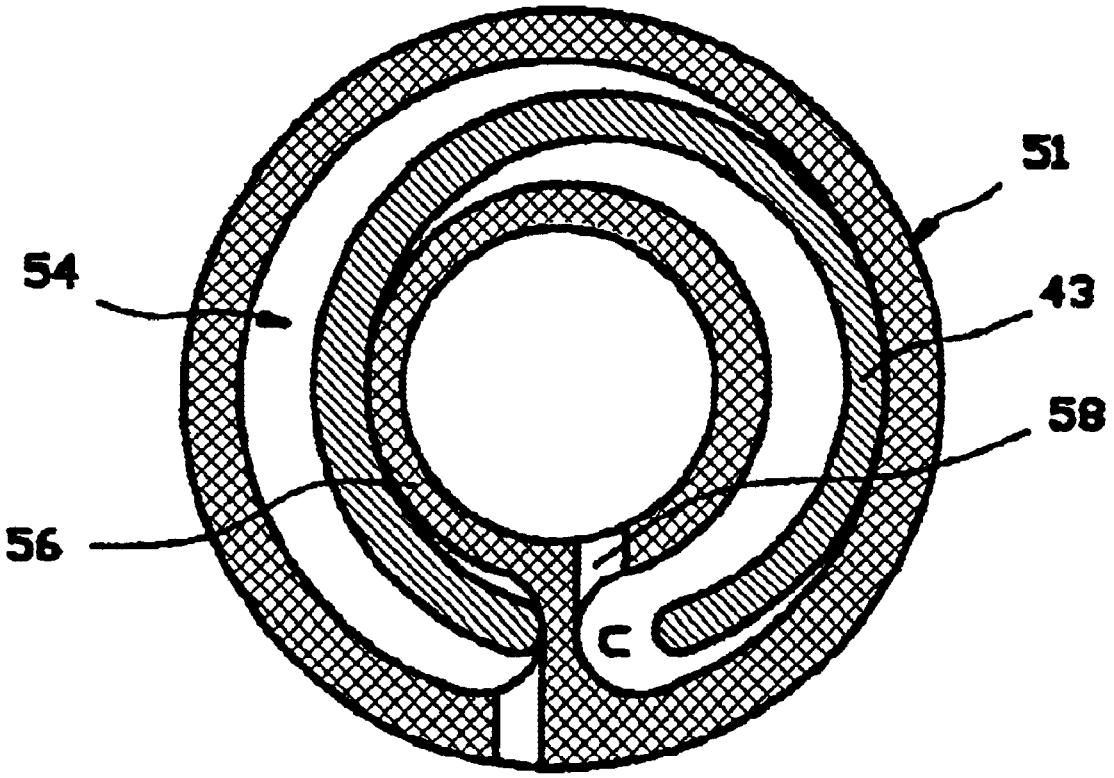

As illustrated in FIG. 3D, when the orbiter 41 performs an orbiting movement of 270°, compressed air in the completely compressed space "c" is discharged into the circular spaces 44 and 52 through the discharge hole 58 and is accumulated in the compressed air tank 31 through the discharge passage 59 and the open portion of the second housing 51.

Although there is described a case where the ring gears 45 and 53 formed in the circumferences of the circular spaces 44 and 52 engage with the sun gears 62 and 63 of the rotation restrainer 61 as in the above embodiment, there may be another case where linear grooves formed in the circumferences of the circular spaces engage with liner projections formed on the rotation restrainer or cross-shaped grooves formed on the rotation restrainer, thus allowing the orbiter 41 to perform an orbiting movement without being rotated.

INDUSTRIAL APPLICABILITY

As described above, the present invention provides a small-sized compressor, in which air supplied from the outside through the air inlet of a second housing enters the compression chamber of the second housing, an orbiter performs a stable orbiting movement in such a way that a space surrounded by a ring gear at its circumference is formed on the upper center portion of the orbiter, and a space surrounded by a ring gear at its circumference is formed on the upper center portion of the orbiter and sun gears of a rotation restrainer are engaged with the ring gears.

Accordingly, air is compressed by the variation of the enclosed volume of a compression chamber because the ring-shaped operating portion is smaller than the compression chamber in the interior of the second housing and larger than the circular vane connected to the second housing through a connecting portion, and air compressed in the compression chamber is moved to a circular space through a discharge hole formed on the right side of a circular vane of the second housing and is accumulated in a compressed air tank through a compressed air discharge hole and the open portion of the second housing. As a result, the small-sized compressor allows the orbiter to perform a stable orbiting movement, can generate highly compressed air in a relatively small space and can be miniaturized, so that it can be mounted on an air conditioner.

We claim:

1. A small-sized compressor, comprising:

a compressed air tank (31);

a first housing (35) provided with a shaft bore (36);

a rotating shaft (32) disposed inside the compressed air tank (31) to be rotated by a motor, inserted into the shaft bore (36) of the first housing (35), and provided at an upper end thereof with a cam shaft portion (33);

an orbiter (41) provided at a lower portion thereof with a cam shaft hole (42) to engage with the cam shaft portion (33) of the rotating shaft (32) without friction, and adapted to form a ring-shaped operating portion (43) and a circular space (44) surrounded by a ring gear (45) thereabove;

a second housing (51) attached to the first housing (35) in a general bolting manner, and adapted to form another circular space (52) offset from the circular space (44) and surrounded by a ring gear (53);

a rotating restrainer (61) provided with two sun gears (62, 63), and disposed in the circular spaces (44, 52) so that the sun gears (62, 63) engage with the ring gears (45, 53), respectively; and a circular vane (56) integrated with the second housing (51) through a connection portion (55) to form a ring-shaped compression chamber (54) together with the second housing (51), and disposed within the ring-shaped operating portion (43) of the orbiter (41), wherein the second housing (51) is provided therethrough with an air supply hole (57) and the circular vane (56) is provided therethrough with an air outlet (58) to connect an interior of the compressed air tank (31) and an open portion of the second housing (51).

* * * * *